US007195539B2

(12) United States Patent
Turner et al.

(10) Patent No.: US 7,195,539 B2
(45) Date of Patent: Mar. 27, 2007

(54) POLISHING PAD WITH RECESSED WINDOW

(75) Inventors: Kyle A. Turner, Frisco, TX (US); Jeffrey L. Beeler, Gilbert, AZ (US); Kelly J. Newell, St. Charles, IL (US)

(73) Assignee: Cabot Microelectronics Coporation, Aurora, IL (US)

( * ) Notice: Subject to any disclaimer, the term of this patent is extended or adjusted under 35 U.S.C. 154(b) by 525 days.

(21) Appl. No.: 10/666,797

(22) Filed: Sep. 19, 2003

(65) Prior Publication Data

US 2005/0060943 A1 Mar. 24, 2005

(51) Int. Cl.
*B24B 49/00* (2006.01)

(52) U.S. Cl. ..... 451/6; 451/527; 451/533

(58) Field of Classification Search ..... 451/6, 451/41, 526, 527, 529, 533, 539
See application file for complete search history.

(56) References Cited

U.S. PATENT DOCUMENTS

| | | | | |
|---|---|---|---|---|
| 5,433,651 | A | 7/1995 | Lustig et al. | |
| 5,605,760 | A | 2/1997 | Roberts | |
| 6,000,996 | A | 12/1999 | Fujiwara | |
| 6,146,242 | A | 11/2000 | Treur et al. | |
| 6,171,181 | B1 | 1/2001 | Budinger et al. | |
| 6,248,000 | B1 | 6/2001 | Aiyer | |
| 6,254,459 | B1 | 7/2001 | Bajaj et al. | |
| 6,280,290 | B1 | 8/2001 | Birang et al. | |
| 6,358,130 | B1 | 3/2002 | Freeman et al. | |
| 6,454,630 | B1 | 9/2002 | Tolles | |
| 6,458,014 | B1 | 10/2002 | Ishikawa et al. | |
| 6,517,417 | B2 | 2/2003 | Roberts et al. | |
| 6,524,164 | B1 | 2/2003 | Tolles | |
| 6,524,176 | B1 | 2/2003 | Cheng et al. | |
| 6,599,765 | B1 | 7/2003 | Boyd et al. | |
| 6,641,470 | B1 * | 11/2003 | Zhao et al. | 451/523 |
| 6,676,483 | B1 * | 1/2004 | Roberts | 451/6 |
| 6,806,100 | B1 * | 10/2004 | Xu et al. | 438/8 |
| 2001/0053658 | A1 | 12/2001 | Budinger et al. | |
| 2002/0127951 | A1 | 9/2002 | Ishikawa et al. | |
| 2002/0137431 | A1 | 9/2002 | Labunsky et al. | |

FOREIGN PATENT DOCUMENTS

| | | | |
|---|---|---|---|
| EP | 1 293 297 | A1 | 3/2003 |
| JP | 11-77517 | A | 9/1997 |
| WO | WO 01/94074 | A1 | 12/2001 |
| WO | WO 02/078902 | A1 | 10/2002 |

* cited by examiner

*Primary Examiner*—Jacob K. Ackun, Jr.
(74) *Attorney, Agent, or Firm*—Caryn Borg-Breen

(57) ABSTRACT

The invention provides a polishing pad for chemical-mechanical polishing comprising (a) a first polishing layer comprising a polishing surface and a first aperture having a first length and first width, (b) a second layer comprising a body and a second aperture having a second length and second width, wherein the second layer is substantially coextensive with the first polishing layer and at least one of the first length and first width is smaller than the second length and second width, and (c) a substantially transparent window portion, wherein the transparent window portion is disposed within the second aperture of the second layer so as to be aligned with the first aperture of the first polishing layer and the transparent window portion is separated from the body of the second layer by a gap. The invention further provides a chemical-mechanical polishing apparatus and method of polishing a workpiece.

22 Claims, 2 Drawing Sheets

POLISHING PAD WITH RECESSED WINDOW

FIELD OF THE INVENTION

This invention pertains to a polishing pad for chemical-mechanical polishing comprising a recessed window that is separated from the body of the polishing pad by a gap.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a workpiece, it is often advantageous to monitor the polishing process in situ. One method of monitoring the polishing process in situ involves the use of a polishing pad having a "window" that provides a portal through which light can pass to allow the inspection of the workpiece surface during the polishing process. Such polishing pads having windows are known in the art and have been used to polish workpieces, such as semiconductor devices. For example, U.S. Pat. No. 5,893,796 discloses removing a portion of a polishing pad to provide an aperture and placing a transparent polyurethane or quartz plug in the aperture to provide a transparent window. Similarly, U.S. Pat. No. 5,605,760 provides a polishing pad having a transparent window formed from a solid, uniform polymer material that is cast as a rod or plug. The transparent plug or window typically is integrally bonded to the polishing pad during formation of the polishing pad (e.g., during molding of the pad) or is affixed in the aperture of the polishing pad through the use of an adhesive.

Typically, windows are mounted into the top polishing pad layer and are either flush with the top polishing surface of the polishing pad or are recessed from the polishing surface. Windows that are mounted flush can become scratched and clouded during polishing and/or during conditioning resulting in polishing defects and hindering endpoint detection. Accordingly, it is desirable to recess the window from the plane of the polishing surface to avoid scratching or otherwise damaging the window. Polishing pads having recessed windows are disclosed in U.S. Pat. Nos. 5,433,651, 6,146,242, 6,254,459, and 6,280,290, as well as U.S. Patent Application No. 2002/0042243 A1 and WO 01/98028 A1.

Conventional methods for affixing a window into a polishing pad typically involve either the use of an adhesive to attach the window to the pad, or an integral molding method. Such conventional methods produce polishing pads which suffer one or both of the following problems: (1) the seal between the polishing pad and the window is either imperfect or deteriorates during use such that polishing slurry leaks through the polishing pad and onto the platen or behind the window thus compromising optical clarity for endpoint detection, and (2) the window may separate from the polishing pad during use and be ejected.

Thus, there remains a need for an effective polishing pad comprising a translucent region (e.g., window) that has improved wear resistant properties and can be produced using efficient and inexpensive methods. The invention provides such a polishing pad, as well as a method of its use. These and other advantages of the present invention, as well as additional inventive features, will be apparent from the description of the invention provided herein.

BRIEF SUMMARY OF THE INVENTION

The invention provides a polishing pad for chemical-mechanical polishing comprising (a) a first polishing layer comprising a polishing surface and a first aperture having a first length and first width, (b) a second layer comprising a body and a second aperture having a second length and second width, wherein the second layer is substantially coextensive with the first polishing layer and at least one of the first length and first width is smaller than the second length and second width, and (c) a substantially transparent window portion, wherein the transparent window portion is disposed within the second aperture of the second layer so as to be aligned with the first aperture of the first polishing layer and the transparent window portion is separated from the body of the second layer by a gap.

The invention further provides a chemical-mechanical polishing apparatus and method of polishing a workpiece. The CMP apparatus comprises (a) a platen that rotates, (b) a polishing pad of the invention, and (c) a carrier that holds a workpiece to be polished by contacting the rotating polishing pad. The method of polishing comprises the steps of (i) providing a polishing pad of the invention, (ii) contacting a workpiece with the polishing pad, and (iii) moving the polishing pad relative to the workpiece to abrade the workpiece and thereby polish the workpiece.

DETAILED DESCRIPTION OF THE INVENTION

Figure 1:
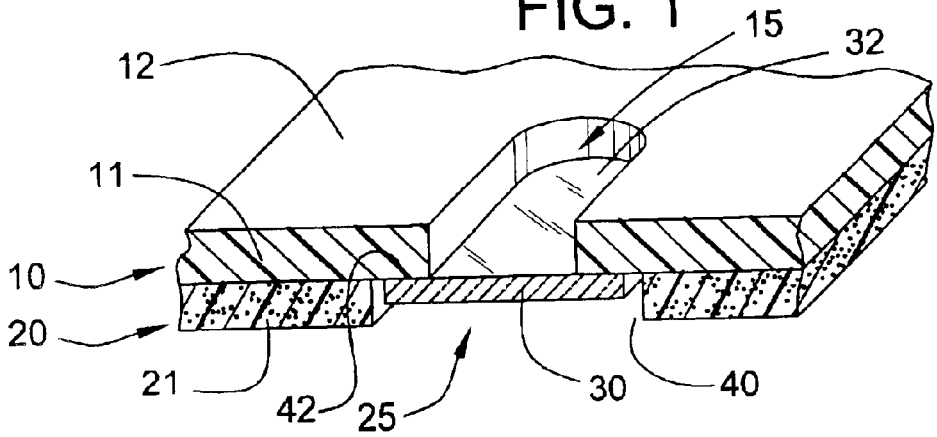
FIG. 1 is a fragmentary, partially cross-sectional perspective view depicting a polishing pad of the invention having a first polishing layer (10) comprising a first aperture (15), a second layer (20) comprising a second aperture (25), and a substantially transparent window portion (30) disposed within the second aperture (25).

The invention is directed to a polishing pad for chemical-mechanical polishing having a recessed transparent window portion. As shown in FIG. 1, the polishing pad comprises a first polishing layer (10) comprising a body (11) and a polishing surface (12), a second layer (20) comprising a body (21), and a substantially transparent window portion (30) comprising a window surface (32). The second layer is substantially coextensive with the first polishing layer. Optionally, adhesive layers are present between the first polishing layer and the second layer, and beneath the second layer.

The first polishing layer further comprises a first aperture (15) having a first length and first width. The second layer further comprises a second aperture (25) having a second length and second width. At least one of the length and width of the first aperture is smaller than the length and width of the second aperture, respectively. Preferably both the length and width of the first aperture are smaller than the length and width of the second aperture, respectively. The transparent window portion (30) has a third length and width that is intermediate between the lengths and widths of the first and second apertures, respectively. The transparent window portion is disposed within the second aperture (25) of the second layer (20) such that it is aligned with the first aperture (15) of the first polishing layer (10). The window surface (32) is recessed from the polishing surface (12) of the first polishing layer.

The transparent window portion (30) is attached to the first polishing layer (10) at the joint (42). The difference in length and/or width of the first and second apertures creates a rim to which the transparent window portion can be attached. The transparent window portion can be attached to the first polishing layer using any suitable means. For example, the transparent window portion can be attached to the first polishing layer through the use of an adhesive, many of which are know in the art. Alternatively, the transparent window portion can be attached to the first polishing layer by a process that does not involve the use of an adhesive, for example by welding (e.g., ultrasonic welding), thermal bonding, or radiation-activated bonding. Preferably, the transparent window portion is attached to the first polishing layer by an ultrasonic welding process.

The transparent window portion (30) is separated from the body (21) of the second layer by a gap (i.e., a space) (40) that is defined by the difference between the second length and second width of the second aperture and the third length and third width of the transparent window portion. Accordingly, the gap is situated about the perimeter of the transparent window portion, respectively. The gap can be present about the entire perimeter of the transparent window portion, or the gap can be present only in certain portions of the perimeter of the transparent window portion (e.g., along opposing sides of the transparent window portion). During polishing, the polishing pad can become compressed, thereby causing the polishing pad to flex. The flexing motion can stress and damage the joint (42) that connects the first polishing layer and the transparent window portion such that polishing slurry leaks through the joint. In extreme cases, the flexing motion causes joint failure and ejection of the transparent window portion from the polishing pad. The presence of the gap between the transparent window portion and the body of the second layer allows the polishing pad to flex during polishing, thereby reducing or eliminating stress on the joint. The gap can have any suitable height or width. The height of the gap typically is about equal to the height of the transparent window portion, although in some embodiments it may be desirable that the height of the gap is less than the height of the transparent window portion. The width of the gap will depend in part on the compressibility of the polishing pad layers, the downforce pressure of the polishing application, and the thickness of the polishing pad layers. Typically, the width of the gap is about 0.1 mm to about 1 mm (e.g., about 0.15 mm to about 0.8 mm). The gap can be a void space or can be filled with a compressible material. Preferably, the compressible material has a compressibility that is less than the compressibility of the second layer. The compressible material can be any suitable compressible material. For example, the compressible material can be a felt or soft porous foam.

Figure 2:
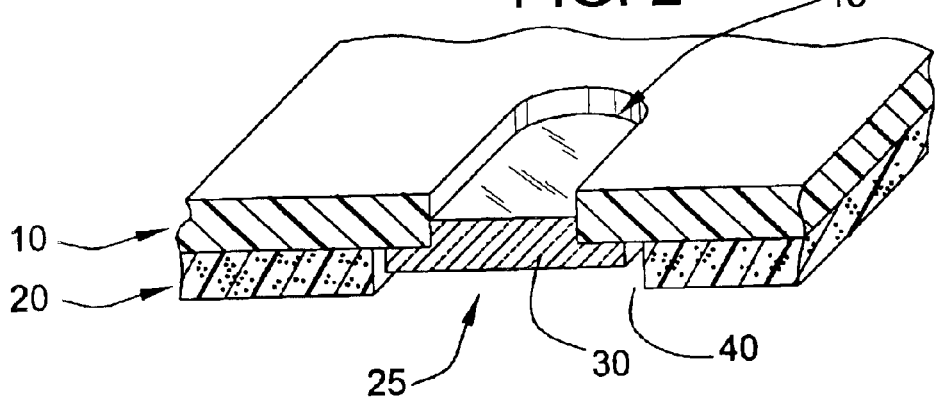
FIG. 2 is a fragmentary, partially cross-sectional perspective view depicting a polishing pad of the invention having a first polishing layer (10) comprising a first aperture (15), a second layer (20) comprising a second aperture (25), and a substantially transparent window portion (30) disposed within the second aperture (25) and the first aperture (15).

The transparent window portion can be recessed from the polishing surface of the first polishing layer by any suitable amount. The amount of recessing will depend on the wear characteristics of the polishing pad layers. Desirably the transparent window portion is recessed by an amount sufficient to ensure that the transparent window portion remains recessed throughout the lifetime of the polishing pad. Typically, the transparent window portion is fully disposed within the second aperture of the second layer as is shown in FIG. 1, such that the amount of recess is defined by the thickness of the first polishing layer. However, in some embodiments, it is desirable to have the transparent window portion disposed within both the first and second apertures. As shown in FIG. 2, the transparent window portion (30) is in the shape of a plug (i.e., having two different sets of dimensions) and is disposed within the second aperture (25) of the second layer, as well as the first aperture (15) of the first polishing layer. Such a configuration allows for the amount of recess of the window surface from the polishing surface to be less than the thickness of the first polishing layer. Preferably, the transparent window portion is recessed from the polishing surface by about 100 microns or more (e.g., about 200 microns or more, or about 300 microns or more).

The transparent window portion can have any suitable thickness. For example, the transparent window portion can have a thickness that is about equal to the thickness of the second layer, is greater than the thickness of the second layer (e.g., a transparent window portion that is disposed in both the second layer and first polishing layer), or is less than the thickness of the second layer. Preferably, the transparent window portion has a thickness that is less than the thickness of the second layer such that the window "floats" in the polishing pad thereby allowing for vertical compression of the polishing pad during polishing. The transparent window portion typically has a thickness of about 0.1 cm to about 0.4 cm (e.g., about 0.2 cm to about 0.3 cm).

The transparent window portion can have any suitable shape and dimension. For example, the transparent window portion can have the shape of a circle, an oval, a rectangle, a square, or an arc. Preferably, the transparent window portion is in the shape of a circle, oval, or rectangle. When the transparent window portion is oval or rectangular in shape, the transparent window portion typically has a length of about 3 cm to about 8 cm (e.g., about 4 cm to about 6 cm) and a width of about 0.5 cm to about 2 cm (e.g., about 1 cm to about 2 cm). When the transparent window portion is circular or square in shape, the transparent window portion typically has a diameter (e.g., width) of about 1 cm to about 4 cm (e.g., about 2 cm to about 3 cm).

Figure 3A:
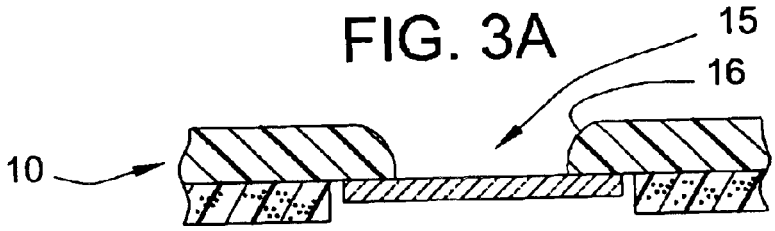
FIG. 3A is a fragmentary, cross-sectional side view depicting a polishing pad of the invention having rounded edges about the perimeter (16) of the first aperture (15) of the first polishing layer (10).
Figure 3B:
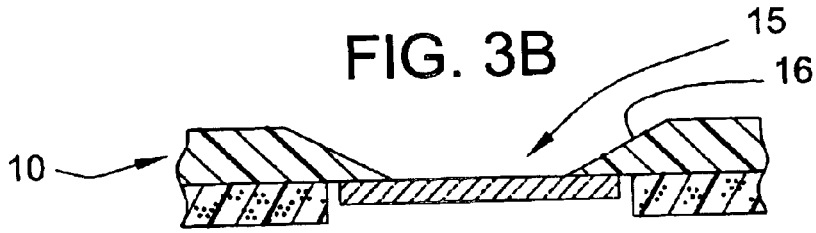
FIG. 3B is a fragmentary, cross-sectional side view depicting a polishing pad of the invention having angled edges about the perimeter (16) of the first aperture (15) of the first polishing layer (10).

Typically, the first aperture and second aperture will have the same shape as the transparent window portion. Preferably, the first aperture of the first polishing layer is shaped such that the flow of polishing slurry over the surface of the transparent window portion is unimpeded. For example, the first aperture (15) in the first polishing layer (10) can have a perimeter (16) that is rounded or angled as shown in FIGS. 3A and 3B, respectively. Additional aperture designs suitable for use in connection with the present invention are disclosed, for example, in WO 01/98028 A1.

The transparent window portion has a light transmittance (i.e., the total amount of light transmitted through the transparent window portion) of about 1% or more (e.g., about 5% or more, about 10% or more, or about 20% or more) at at least one wavelength of light from about 200 nm to about 10,000 nm (e.g., from about 200 nm to about 1000 nm, or from about 200 nm to about 800 nm).

Figure 4:
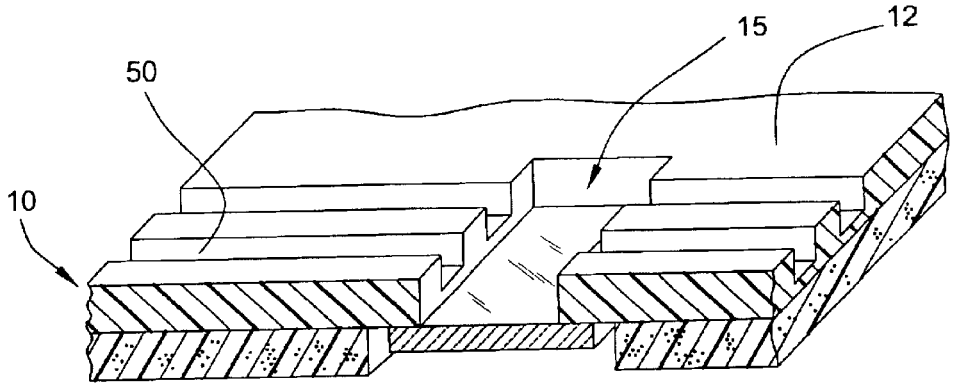
FIG. 4 is a fragmentary, partially cross-sectional perspective view depicting a polishing pad of the invention having a first polishing layer (10) comprising a first aperture (15) and a polishing surface (12) comprising grooves that are aligned on either side of the first aperture.
Figure 5:
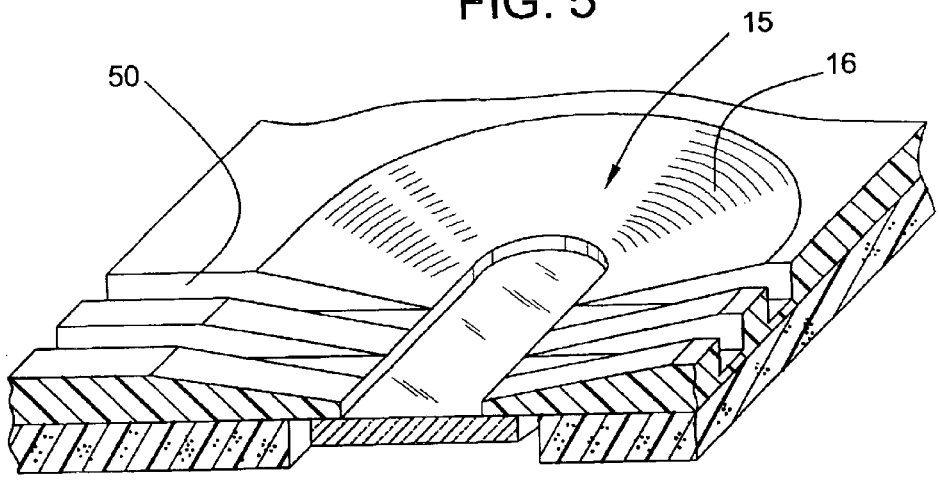
FIG. 5 is a fragmentary, partially cross-sectional perspective view depicting a polishing pad of the invention comprising a first aperture (15) with an angled perimeter (16) and grooves (50) that are aligned on either side of the first aperture.

The polishing surface of the first polishing layer optionally further comprises grooves, channels, or perforations that facilitate the flow of the polishing slurry across the surface of the polishing pad. Preferably, the polishing surface comprises grooves. The grooves can be in any suitable pattern and can have any suitable depth and width. The polishing surface can have two or more different groove patterns, for example a combination of large grooves and small grooves. The grooves can be in the form of slanted grooves, concentric grooves, spiral or circular grooves, or XY crosshatch pattern, and can be continuous or non-continuous in connectivity. Desirably, the grooves are configured such that they direct the flow of polishing slurry across the surface of the transparent window portion. As shown in FIG. 4, the grooves (50) preferably are aligned on either side of the first aperture (15) of the first polishing layer (10). The grooves can have any suitable width or depth. Preferably, the depth of the grooves is about 10% to about 90% of the thickness of the first polishing layer. A preferred polishing pad comprises grooves (50) in combination with an aperture (15) having a rounded perimeter (16) as shown in FIG. 5.

The first polishing layer, second layer, and transparent window portion of the polishing pad can comprise any suitable material, which can be the same or different. Desirably, the first polishing layer, second layer, and transparent window portion of the polishing pad each independently comprise a polymer resin. The polymer resin can be any suitable polymer resin. Typically, the polymer resin is selected from the group consisting of thermoplastic elastomers, thermoset polymers, polyurethanes (e.g., thermoplastic polyurethanes), polyolefins (e.g., thermoplastic polyolefins), polycarbonates, polyvinylalcohols, nylons, elastomeric rubbers, elastomeric polyethylenes, polytetrafluoroethylenes, polyethyleneterephthalates, polyimides, polyaramides, polyarylenes, polyacrylates, polystyrenes, polymethylmethacrylates, copolymers thereof, and mixtures thereof. Preferably, the polymer resin is polyurethane, more preferably thermoplastic polyurethane. The first polishing layer, second layer, and transparent window portion can comprise a different polymer resin. For example, the first polishing layer can comprise porous thermoset polyurethane, the second layer can comprise closed-cell porous polyurethane foam, and the transparent window portion can comprise solid thermoplastic polyurethane.

The first polishing layer and second layer typically will have different chemical (e.g., polymer composition) and/or physical properties (e.g., porosity, compressibility, transparency, and hardness). For example, the first polishing layer and second layer can be closed cell (e.g., a porous foam), open cell (e.g., a sintered material), or solid (e.g., cut from a solid polymer sheet). Preferably the first polishing layer is less compressible than the second layer. The first polishing layer and second layer can be formed by any method known in the art. Suitable methods include casting, cutting, reaction injection molding, injection blow molding, compression molding, sintering, thermoforming, or pressing the porous polymer into the desired polishing pad shape. Other polishing pad elements also can be added to the porous polymer before, during, or after shaping the porous polymer, as desired. For example, backing materials can be applied, holes can be drilled, or surface textures can be provided (e.g., grooves, channels), by various methods generally known in the art.

The first polishing layer and second layer optionally further comprise organic or inorganic particles. For example, the organic or inorganic particles can be selected from the group consisting of metal oxide particles (e.g., silica particles, alumina particles, ceria particles), diamond particles, glass fibers, carbon fibers, glass beads, aluminosilicates, phyllosilicates (e.g., mica particles), cross-inked polymer particles (e.g., polystyrene particles), water-soluble particles, water-absorbent particles, hollow particles, combinations thereof, and the like. The particles can have any suitable size, for example the particles can have an average particle diameter of about 1 nm to about 10 microns (e.g., about 20 nm to about 5 microns). The amount of the particles in the body of the polishing pad can be any suitable amount, for example, from about 1 wt. % to about 95 wt. % based on the total weight of the polishing pad body.

Similarly, the transparent window portion can have any suitable structure (e.g., crystallinity), density, and porosity. For example, the transparent window portion can be solid or porous (e.g., microporous or nanoporous having an average pore size of less than 1 micron). Preferably, the transparent window portion is solid or is nearly solid (e.g., has a void volume of about 3% or less). The transparent window portion optionally further comprises particles selected from polymer particles, inorganic particles, and combinations thereof. The transparent window portion optionally contains pores.

The transparent window portion optionally further comprises a dye, which enables the polishing pad material to selectively transmit light of a particular wavelength(s). The dye acts to filter out undesired wavelengths of light (e.g., background light) and thus improve the signal to noise ratio of detection. The transparent window portion can comprise any suitable dye or may comprise a combination of dyes. Suitable dyes include polymethine dyes, di-and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 mm, the dye preferably is a red dye, which is capable of transmitting light having a wavelength of about 633 mm.

As one of ordinary skill in the art would appreciate, the polishing pad of the invention optionally further comprises polishing pad layers in addition to the first polishing layer and the second layer. For example, the polishing pad can comprise a third layer disposed between the first polishing layer and the second layer. The third layer comprises a third aperture that is aligned with the first and second apertures. Desirably, the dimensions of the third aperture would be approximately equal to those of either the first aperture or the second aperture.

The polishing pad of the invention is particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad. The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pad of the invention is suitable for use in a method of polishing many types of workpieces (e.g., substrates or wafers) and workpiece materials. For example, the polishing pads can be used to polish workpieces including memory storage devices, glass substrates, memory or rigid disks, metals (e.g., noble metals), magnetic heads, inter-layer dielectric (ILD) layers, polymeric films, low and high dielectric constant films, ferroelectrics, micro-electro-mechanical systems (MEMS), semiconductor wafers, field emission displays, and other microelectronic substrates, especially microelectronic substrates comprising insulating layers (e.g., metal oxide, silicon nitride, or low dielectric materials) and/or metal-containing layers (e.g., copper, tantalum, tungsten, aluminum, nickel, titanium, platinum, ruthenium, rhodium, iridium, alloys thereof, and mixtures thereof). The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material. Suitable metal oxide insulating layers include, for example, alumina, silica, titania, ceria, zirconia, germania, magnesia, and combinations thereof. In addition, the workpiece can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The workpiece also can comprise, consist essentially of, or consist of any suitable semiconductor base material. Suitable semiconductor base materials include single-crystal silicon, poly-crystalline silicon, amorphous silicon, silicon-on-insulator, and gallium arsenide.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for chemical-mechanical polishing comprising:

(a) a first polishing layer comprising a polishing surface and a first aperture having a first length and first width, (b) a second layer comprising a body and a second aperture having a second length and second width, wherein the second layer is substantially coextensive with the first polishing layer and at least one of the first length and first width is smaller than the second length and second width, respectively, and (c) a substantially transparent window portion, wherein the transparent window portion is disposed within the second aperture of the second layer so as to be aligned with the first aperture of the first polishing layer and the transparent window portion is separated from the body of the second layer by a gap.

2. The polishing pad of claim 1, wherein the transparent window portion is adhered to the first polishing layer.

3. The polishing pad of claim 1, wherein the transparent window portion is welded to the first polishing layer.

4. The polishing pad of claim 1, wherein both the first length and first width are smaller than the second length and second width, respectively.

5. The polishing pad of claim 1, wherein the gap has a width of about 0.1 mm to about 1 mm.

6. The polishing pad of claim 1, wherein the gap is filled with a compressible material.

7. The polishing pad of claim 1, wherein the perimeter of the first aperture is angled.

8. The polishing pad of claim 1, wherein the perimeter of the first aperture is rounded.

9. The polishing pad of claim 1, wherein the transparent window portion is further disposed within the first aperture of the first polishing layer.

10. The polishing pad of claim 1, wherein the polishing surface of the first polishing layer further comprises one or more grooves.

11. The polishing pad of claim 10, wherein the grooves are aligned on either side on the aperture.

12. The polishing pad of claim 1, wherein the transparent window portion has a thickness that is less than the thickness of the second layer.

13. The polishing pad of claim 1, wherein the first polishing layer comprises polyurethane.

14. The polishing pad of claim 1, wherein the transparent window portion comprises thermoplastic polyurethane.

15. The polishing pad of claim 14, wherein the transparent window portion has a light transmittance of about 1% or more at at least one wavelength from about 200 nm to about 10,000 nm.

16. The polishing pad of claim 14, wherein the transparent window portion further comprises particles selected from polymer particles, inorganic particles, and combinations thereof.

17. The polishing pad of claim 1, wherein the transparent window portion contains pores.

18. A chemical-mechanical polishing apparatus comprising:

(a) a platen that rotates, (b) the polishing pad of claim 1, and (c) a carrier that holds a workpiece to be polished by contacting the rotating polishing pad.

19. The chemical-mechanical polishing apparatus of claim 18, further comprising an in situ polishing endpoint detection system.

20. A method of polishing a workpiece comprising (i) providing the polishing pad of claim 1, (ii) contacting a workpiece with the polishing pad, and (iii) moving the polishing pad relative to the workpiece to abrade the workpiece and thereby polish the workpiece.

21. The method of claim 20, wherein the method further comprises monitoring the progress of polishing of the workpiece, while the polishing pad is moved relative to the workpiece to abrade the workpiece and thereby polishing the workpiece, with an in situ polishing endpoint detection system.

22. The method of claim 20, wherein the method further comprises determining the endpoint of the polishing of the workpiece with the in situ polishing endpoint detection system.

* * * * *